US011123614B2

(12) United States Patent
Parente et al.

(10) Patent No.: US 11,123,614 B2
(45) Date of Patent: Sep. 21, 2021

(54) MAGNESIUM GOLF CLUBHEAD INSERT

(71) Applicant: Sacks Parente Golf Company, LLC, Westlake Village, CA (US)

(72) Inventors: Richard E. Parente, Imperial Beach, CA (US); Steve Sacks, El Cajon, CA (US); Gene Richard Parente, San Diego, CA (US)

(73) Assignee: SACKS PARENTE GOLF COMPANY, LLC, Westlake Village, CA (US)

( * ) Notice: Subject to any disclaimer, the term of this patent is extended or adjusted under 35 U.S.C. 154(b) by 0 days.

(21) Appl. No.: 16/450,951

(22) Filed: Jun. 24, 2019

(65) Prior Publication Data

US 2020/0398119 A1 Dec. 24, 2020

(51) Int. Cl.
*A63B 53/04* (2015.01)

(52) U.S. Cl.
CPC ..... *A63B 53/04* (2013.01); *A63B 53/0487* (2013.01); *A63B 2209/00* (2013.01)

(58) Field of Classification Search
CPC .. A63B 53/0487; A63B 53/04; A63B 2209/00
See application file for complete search history.

(56) References Cited

U.S. PATENT DOCUMENTS 5,439,223 A * 8/1995 Kobayashi ..... A63B 53/04 473/334
5,464,215 A * 11/1995 Koehler ..... A63B 53/0487 473/341
D417,711 S * 12/1999 Sery ..... D21/744
6,435,979 B1 * 8/2002 Mounfield, Jr. ..... A63B 53/04 473/324
6,530,848 B2 * 3/2003 Gillig ..... A63B 53/0466 473/334
7,048,648 B2 * 5/2006 Breier ..... A63B 53/0487 473/340
7,066,834 B2 * 6/2006 Yamamoto ..... A63B 53/047 473/342
7,086,963 B1 * 8/2006 Onuki ..... A63B 53/04 473/342
7,294,065 B2 * 11/2007 Liang ..... A63B 53/0466 473/335
D599,423 S * 9/2009 Serrano ..... D21/736
D599,869 S * 9/2009 Serrano ..... D21/736
7,604,548 B2 * 10/2009 Cole ..... A63B 53/0487 473/324

(Continued)

FOREIGN PATENT DOCUMENTS

JP 2003-126314 * 5/2003
JP 2006-116208 * 5/2006

*Primary Examiner* — Stephen L Blau
(74) *Attorney, Agent, or Firm* — Steven M. Greenberg, Esq.; Shutts & Bowen LLP

(57) ABSTRACT

A golf club includes a shaft and a clubhead coupled to the shaft by a hosel. The clubhead includes a face, a toe at a distal end of the clubhead and a heel at an opposite distal end of the clubhead and opposite the toe. The clubhead further includes a magnesium insert disposed on the face of the clubhead between the toe and heel of the clubhead as a striking surface of the clubhead. The clubhead even further includes weighting material of a second density that is more than a first density of a material of the clubhead in place of a portion of the material of the clubhead.

9 Claims, 6 Drawing Sheets

(56) References Cited

U.S. PATENT DOCUMENTS

| | | | | |
|---|---|---|---|---|
| 7,682,263 | B2 * | 3/2010 | Yamamoto | A63B 53/04 473/335 |
| 7,699,719 | B2 * | 4/2010 | Sugimoto | A63B 53/0466 473/345 |
| 8,241,141 | B2 * | 8/2012 | Takechi | A63B 53/047 473/329 |
| D896,903 | S * | 9/2020 | Schweigert | D21/743 |
| 2004/0171434 | A1 * | 9/2004 | Radcliffe | A63B 53/04 473/324 |
| 2008/0070720 | A1 * | 3/2008 | Cole | A63B 53/0487 473/341 |
| 2016/0038799 | A1 * | 2/2016 | de la Cruz | A63B 53/0466 473/342 |
| 2019/0070467 | A1 * | 3/2019 | Wahl | A63B 60/54 |

* cited by examiner

MAGNESIUM GOLF CLUBHEAD INSERT

BACKGROUND OF THE INVENTION

Field of the Invention

The present invention relates to the field of golf clubs and more particularly to golf clubhead inserts.

Description of the Related Art

A golf club, in its most basic form, is composed of a shaft and a clubhead. However, slight nuances in golf club design greatly affect the type of shot for which the golf club is designed. Normally, golf clubheads are designed in four main categories: Woods for long-distance shots; irons for a variety of shots; putters for use on the green to stroke the ball into the hole; and hybrids that normally combine aspects of wood and iron club design.

Slight changes to the design, such as material, weighting and shape of the different type of golf clubs have significant effects on the shot of a golfer. Therefore, golf club designs will employ different types of weight distribution in order to target specific shots or specific golfers. Foreweighting is the process of weighting a club whereby most of the weight is in the face area of a club done to bring the center of gravity forward in the clubhead. Backweighting is the process of adding an amount of weight to the rear portion of a wood club in order to move the center of gravity back in the clubhead, which is normally done by attaching preformed brass or steel pieces to the rear of the wood head, or by pouring lead into a rear cavity. Heel/toe weighting is the process of relocating weight from the center of a wood or iron equally to the toe and heel, which does not change the center of gravity but does improve off-center hits by putting more mass in these areas. Golf clubs may be designed with varying degrees and combinations of the above-mentioned weight distribution characteristics so that each golfer will be able find their desired golf club.

A golf club may also be designed to include an insert on the face of the clubhead. Historically, the insert is a piece of material placed into a routed cavity in the face of wood head, designed to improve the durability of the face from impact between the ball and clubhead. The insert is normally made from cycolac, epoxy, vulcanized fiber, aluminum, wood, radiated fiberglass, graphite, melamime, titanium, brass, phenolic laminate and acrylics. Outside of wood heads, the insert is used mainly as a decorative piece on metal woods and irons and made from the same material as the rest of the clubhead. However, unlike the weights used for foreweighting, backweighting and heel/toe weighting mentioned above, the insert is not used to adjust the weighting characteristics of the golf club and only used for protective and decorative purposes.

In a putter, metal inserts are used because the metal insert transfers force most efficiently between the clubhead and the ball. Therefore, aluminum may be utilized as an insert; however, aluminum is not the lightest structural metal. Magnesium is the lightest structural metal; however, magnesium is not used in golf club design due to the dangers of working with magnesium. Magnesium is known to be extremely flammable. Not only does the dust become extremely flammable when working magnesium, it may be extremely dangerous to strike a golf ball with a magnesium insert. Therefore, although magnesium and magnesium alloys are strong, lightweight materials, magnesium and magnesium alloys are not utilized in golf club design due to the dangers of magnesium.

BRIEF SUMMARY OF THE INVENTION

Embodiments of the present invention address deficiencies of the art in respect to golf clubs and provide a novel and non-obvious apparatus for a magnesium golf club insert. In an embodiment of the invention, a golf club includes a shaft and a clubhead coupled to the shaft by a hosel. The clubhead includes a face, a toe at a distal end of the clubhead and a heel at an opposite distal end of the clubhead and opposite the toe. The clubhead further includes a magnesium insert disposed on the face of the clubhead between the toe and heel of the clubhead as a striking surface of the clubhead. The clubhead even further includes weighting material of a second density that is more than a first density of a material of the clubhead in place of a portion of the material of the clubhead.

In one aspect of the embodiment, the magnesium insert is formed entirely from magnesium. In another aspect of the embodiment, the magnesium insert is formed entirely from a magnesium alloy. In another aspect of the embodiment, the clubhead is stainless steel. In another aspect of the embodiment, the clubhead is carbon steel. In another aspect of the embodiment, the weighting material is tungsten. In another aspect of the embodiment, the weighting material is proximate to the toe of the clubhead. In another aspect of the embodiment, the weighting material is proximate to the heel of the clubhead. In yet another aspect of the embodiment, the weighting material comprises a first weighting material proximate to the toe of the clubhead and a second weighting material proximate to the heel of the clubhead. In even yet another aspect of the embodiment, for each cubic centimeter of magnesium of the insert, between 0.55 to 0.66 cubic centimeters of the material of the clubhead is replaced with the weighting material.

In another embodiment of the invention. A golf club includes a shaft and a clubhead coupled to the shaft by a hosel. The clubhead includes a face, a toe at a distal end of the clubhead and a heel at an opposite distal end of the clubhead and opposite the toe wherein the clubhead is of a material selected from the group consisting of stainless steel and carbon steel. The clubhead further includes a magnesium insert disposed on the face of the clubhead between the toe and heel of the clubhead as a striking surface of the clubhead wherein the magnesium insert is formed entirely from a magnesium alloy. The clubhead even further includes weighting material disposed on the face of the clubhead comprising tungsten, wherein the weighting material comprises a first weighting material proximate to the toe of the clubhead and a second weighting material proximate to the heel of the clubhead. The clubhead even further includes that for each cubic centimeter of magnesium of the insert, between 0.55 to 0.66 cubic centimeters of the material of the clubhead is replaced with the weighting material.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for a golf club that includes a shaft and clubhead connected to the shaft by a hosel. The clubhead is made from carbon steel or stainless steel and includes a face, a toe at a distal end of the clubhead and a heel at an opposite distal end of the clubhead and opposite the toe. The clubhead further includes an insert disposed on the face of the clubhead between the toe and heel of the clubhead as a striking surface of the clubhead. Importantly, the insert is made from magnesium or a magnesium alloy, collectively magnesium. In order to maintain the overall weight of the clubhead with the magnesium insert while adjusting the weighting characteristics of the clubhead, for each cubic centimeter of magnesium of the insert, between 0.55 to 0.66 cubic centimeters of the carbon steel or stainless steel of the clubhead is replaced with tungsten. In this way, the damping characteristics of the magnesium insert may be utilized so that vibrations are less likely to be transferred through the golf club. As well, by utilizing a magnesium insert and replacing a portion of the clubhead with tungsten, the same total weight of the club made entirely from steel is maintained while adjusting the swing weighting and toe/heel weighting characteristics of the clubhead through the use of a heavier material, such as tungsten. None of the foregoing would be possible when using aluminum as the foregoing requires the strong, lightweight characteristics of magnesium and magnesium alloys that have a density between 1.74 to 1.8 grains per cubic centimeter and have a damping or dampening effect of about one hundred times that of carbon steel.

Figure 1:
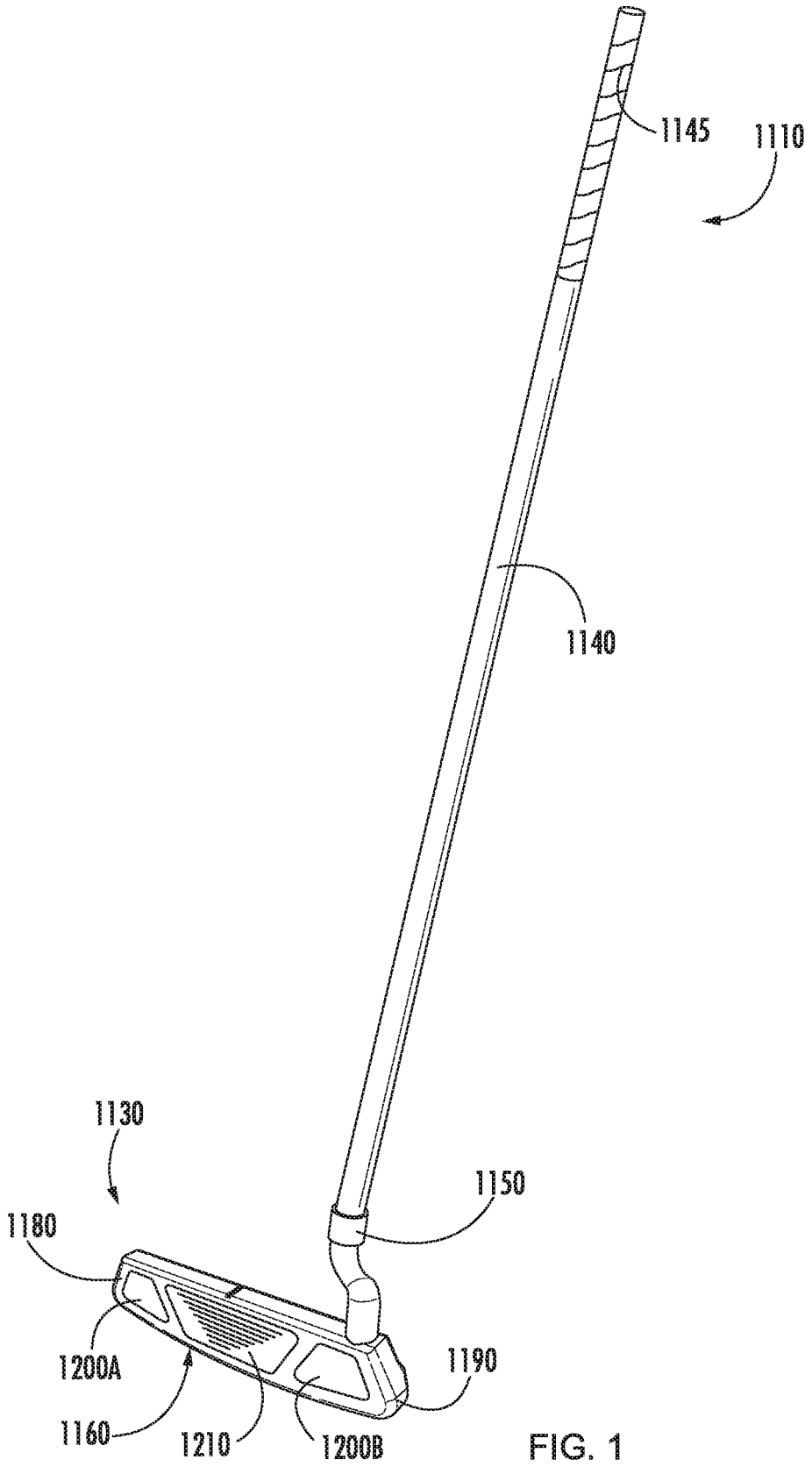
FIG. 1 is top front perspective view of a golf club in accordance with an embodiment of this invention.
Figure 2A:
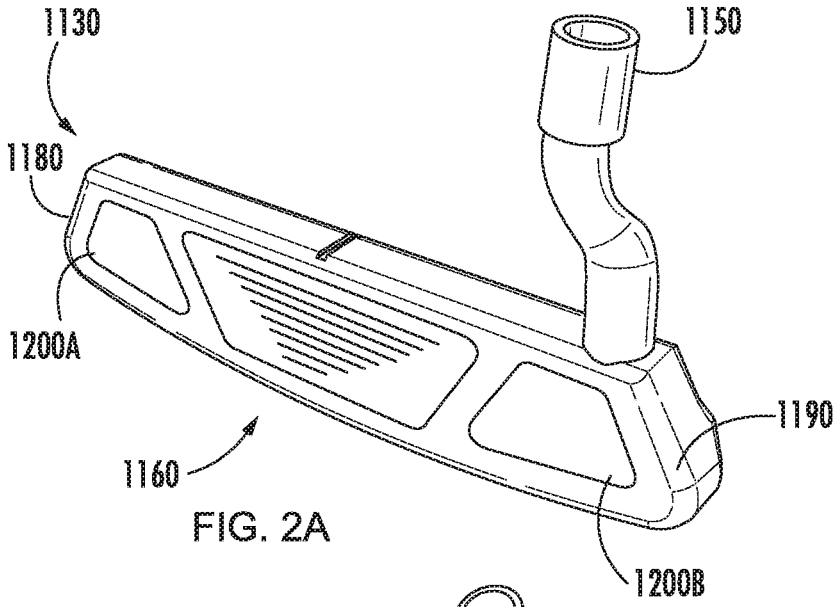
FIG. 2A is a top front perspective view of a clubhead in accordance with an embodiment of this invention.
Figure 2B:
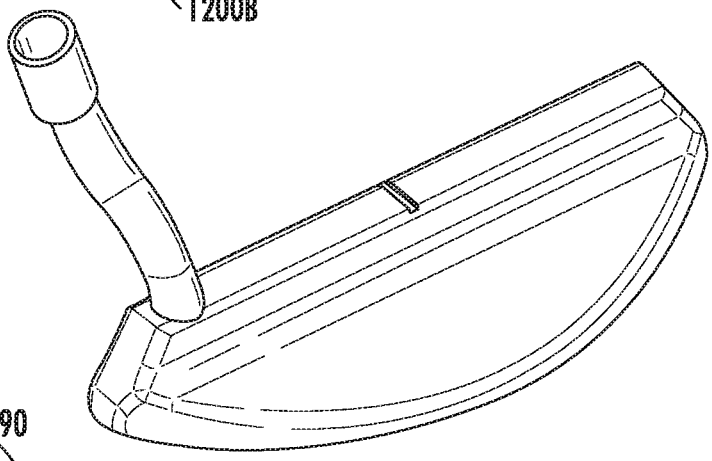
FIG. 2B is a top rear perspective view of a clubhead in accordance with an embodiment of this invention.
Figure 2C:
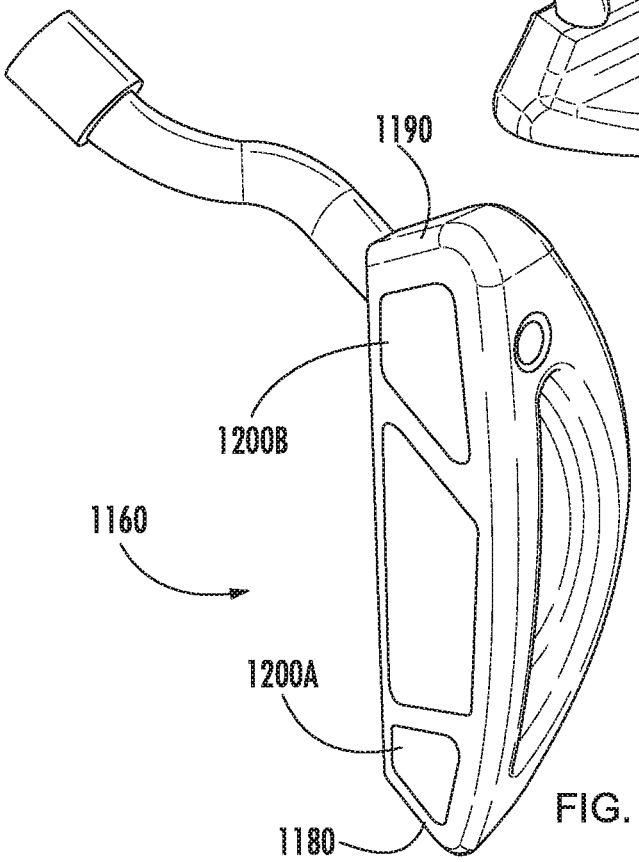
FIG. 2C is a bottom rear perspective view of a clubhead in accordance with an embodiment of this invention.

In further illustration, FIGS. 1 through 2C shows views of a golf club 1110 in accordance with an embodiment of this invention. As can be seen, golf club 1110 includes a shaft 1140 and a clubhead 1130 coupled to the shaft 1140 by a hosel 1150. The clubhead 1130 includes a face 1160, a toe 1180 at a distal end of the clubhead and a heal 1190 at an opposite distal end of the clubhead and opposite the toe. As well, the clubhead may include an insert 1210 and weighting materials 1200A and 1200B. The clubhead may have material removed to reduce the total weight of the clubhead as shown in FIG. 2C. Preferably, the material would be removed around the centerline of the clubhead to optimize the swingweight relative to the total weight of the clubhead and/or to reduce the total weight of the clubhead. As can be seen from FIG. 2C, the material removed is offset from the shape of the putter. However, material may be removed from any area of the clubhead and in any shape in order for the clubhead to address the desired weighting schemes of the user.

The clubhead 1130, weighting materials 1200A and 1200B and insert 1210 can be manufactured using any procedure, including but not limited to investment casting, milling, forging, sand casting, die casting, injection molding, and pressed powdered metal. In addition, the clubhead 1130, weighting materials 1200A and 1200B and insert 1210 can be manufactured from any material, including but not limited to stainless steel, carbon steel, copper, tungsten, magnesium, magnesium alloys, brass, aluminum, manganese, bronze, zinc, steel, titanium, graphite, wood, and any combination of any material. The clubhead 1130, weighting materials 1200A and 1200B and insert 1210 be of any shape and design. Furthermore, the clubhead 1130 may be of any shape, design and mass. The mass of the clubhead, including the weighting materials and insert, will likely be under four hundred twenty grams and around three hundred thirty grams to about three hundred seventy grams. The most typical weight of the clubhead, including the weighting materials and insert, is between three hundred fifty to three hundred sixty grams. However, any mass of the clubhead, including the weighting materials and insert, is within the scope of this invention.

The clubhead 1130 can be coupled to a shaft 1140 using any method, including but not limited to plugs, pins, welding, and epoxy. The shaft 1140 can made of any material or combination thereof, including but not limited to carbon, graphite, and high modulus composites. The shaft 1140 can be manufactured by any process, including but not limited to sheet rolling, table rolling, filament winding, and resin transfer molding. The shaft 1140 can be manufactured to any size and shape.

Coupled to the shaft 1140 can be a grip 1145. The grip 1145 can be made from any material or combination thereof, including rubber, kraton, cork, polyurethane, composites, including polyurethane and thin leather. The grip 1145 can be applied to the shaft 1140 by any method, including but not limited to slip-on and wrap-on. In addition, the grip 1145 can be secured to the shaft 1140 by any method, including but not limited to pressure wrapping, tape, cement, and glue. The length of the grip 1145 is not specifically defined, but can be of any length. Of note, it is possible to have a partial grip or no grip.

For the purposes of this invention, the putter clubhead 1130 may be made from stainless steel and/or carbon steel.

As the density of stainless steel and carbon steel range from 7.7 to 7.85 grams per cubic centimeter, a solid stainless steel or carbon steel putter head of 350 to 360 grams will have a volume or displacement of 44 cubic centimeters to 47 cubic centimeters. Importantly, the insert 1210 is made from magnesium. The magnesium will have a density between 1.74 to 1.8 grams per cubic centimeter. As the insert is made from magnesium, the clubhead will have material removed and replaced with the magnesium insert in that region. As such, for every cubic centimeter of magnesium used, the net total weight loss of the clubhead would be approximately 6 grams. A typical face insert has a volume or displacement between 2 to 8 cubic centimeters. Therefore, this would equate to a weight loss of 12 to 48 grams of the clubhead when the stainless steel or carbon steel is replaced magnesium for the insert. In order to use the magnesium insert while maintaining the overall weight and shape of the clubhead, the stainless steel or carbon steel of the clubhead must be replaced with a heavier density material shown by the weighting materials 1200A and 1200B.

Weighting materials 1200A and 1200B may be made from tungsten with a density between 16.5 to 18.5 grains per cubic centimeter. Accordingly, for each cubic centimeter of magnesium used, 0.55 to 0.65 cubic centimeters of stainless steel or carbon steel of the clubhead is replaced with tungsten throughout weighting materials 1200A and 1200B. If instead of tungsten, copper is used to replace the stainless steel or carbon steel of the clubhead, approximately 6 cubic centimeters must be replaced with copper, which is far less efficient than tungsten. In order to maximize swingweight relative to total weight, the weighting materials 1200A and 1200B are placed as far forward to the front face 1160 away from the centerline of the clubhead. As well, the weighting materials 1200A and 1200B are placed closer to the toe 1180 and heel 1190, in order to maximize the toe/heel weighting characteristics of each of the weights.

Figure 3:
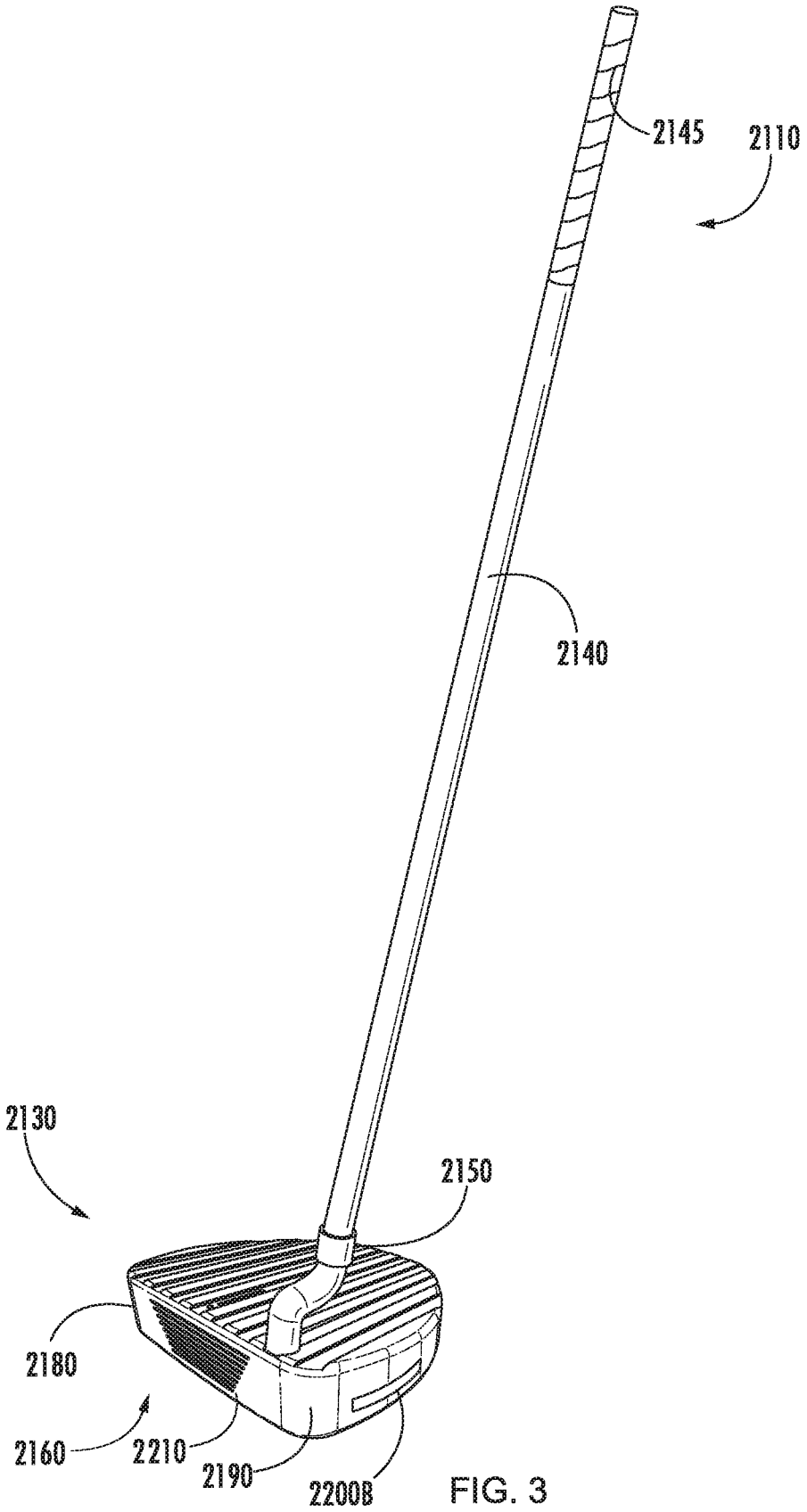
FIG. 3 is a top front perspective view of a golf club in accordance with an embodiment of this invention.
Figure 4A:
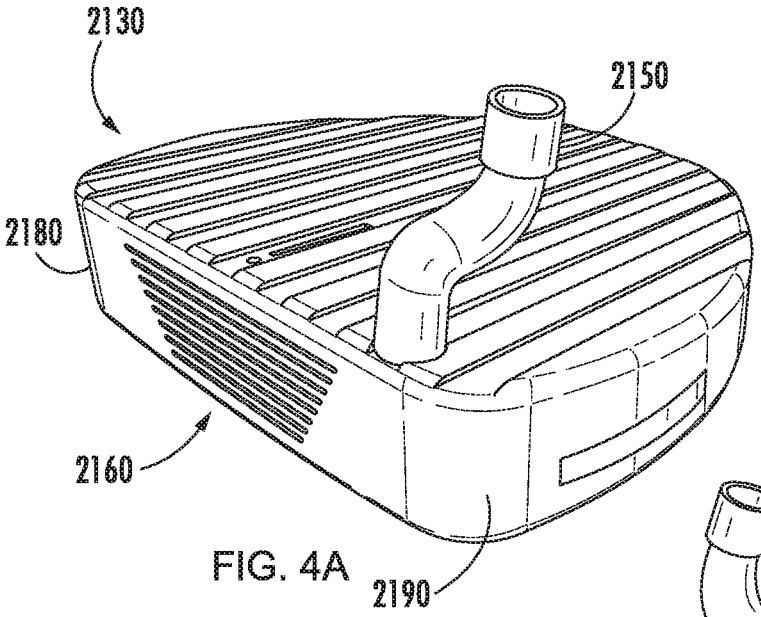
FIG. 4A is a top front perspective view of a clubhead in accordance with an embodiment of this invention.
Figure 4B:
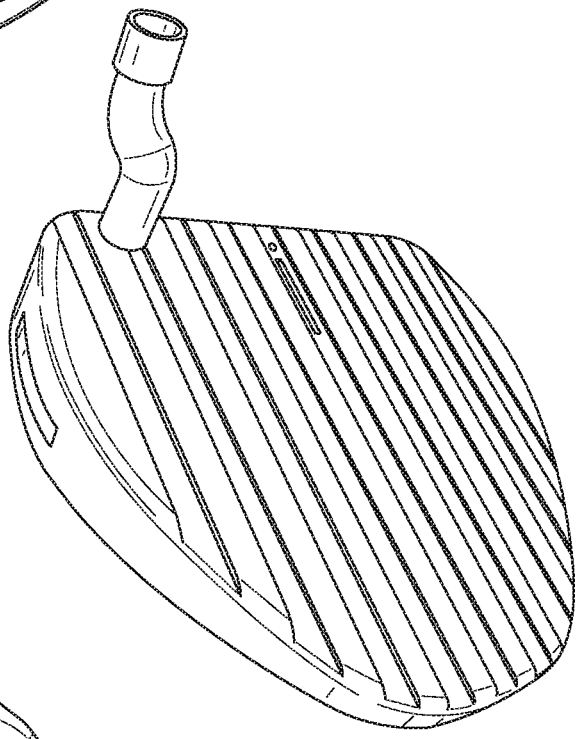
FIG. 4B is a top rear perspective view of a clubhead in accordance with an embodiment of this invention.
Figure 4C:
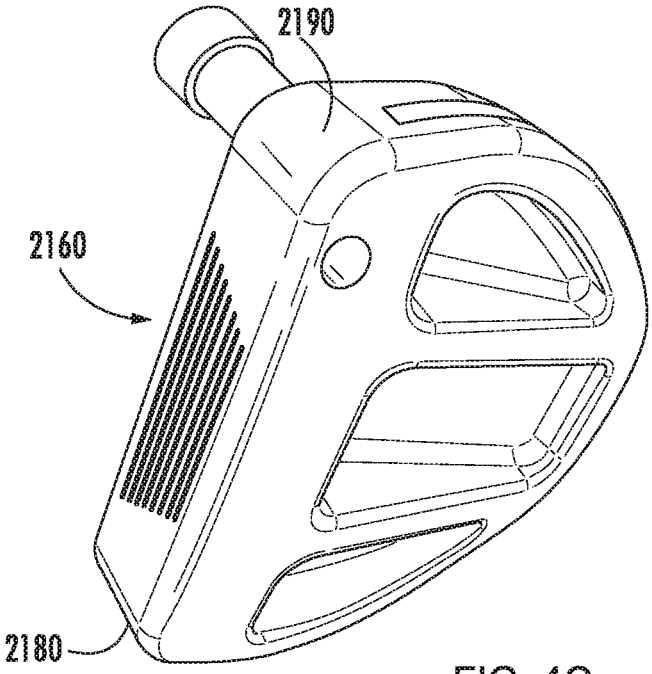
FIG. 4C is a bottom rear perspective view of a clubhead in accordance with an embodiment of this invention.
Figure 5A:
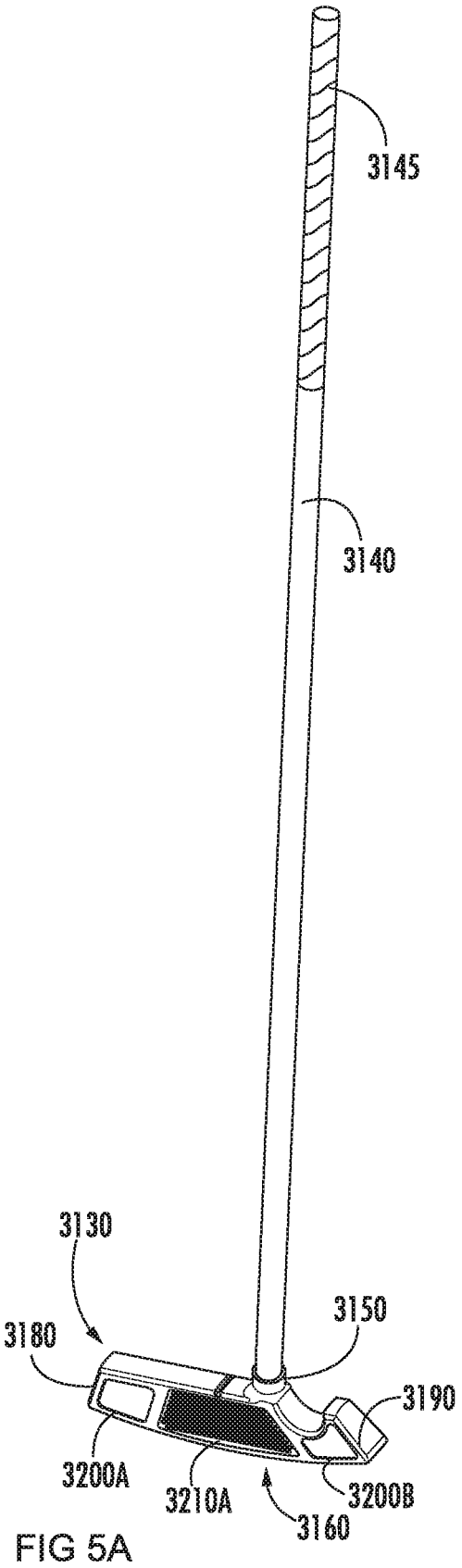
FIG. 5A is a top front perspective view of a golf club in accordance with an embodiment of this invention.
Figure 5B:
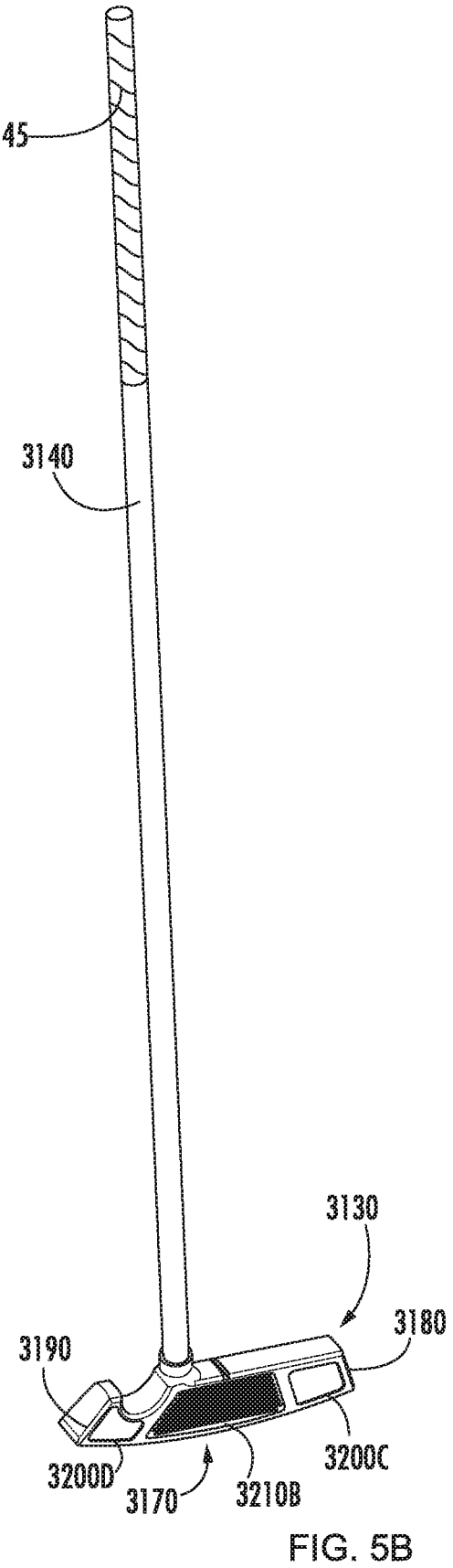
FIG. 5B is a top rear perspective view of a golf club in accordance with an embodiment of this invention.
Figure 6A:
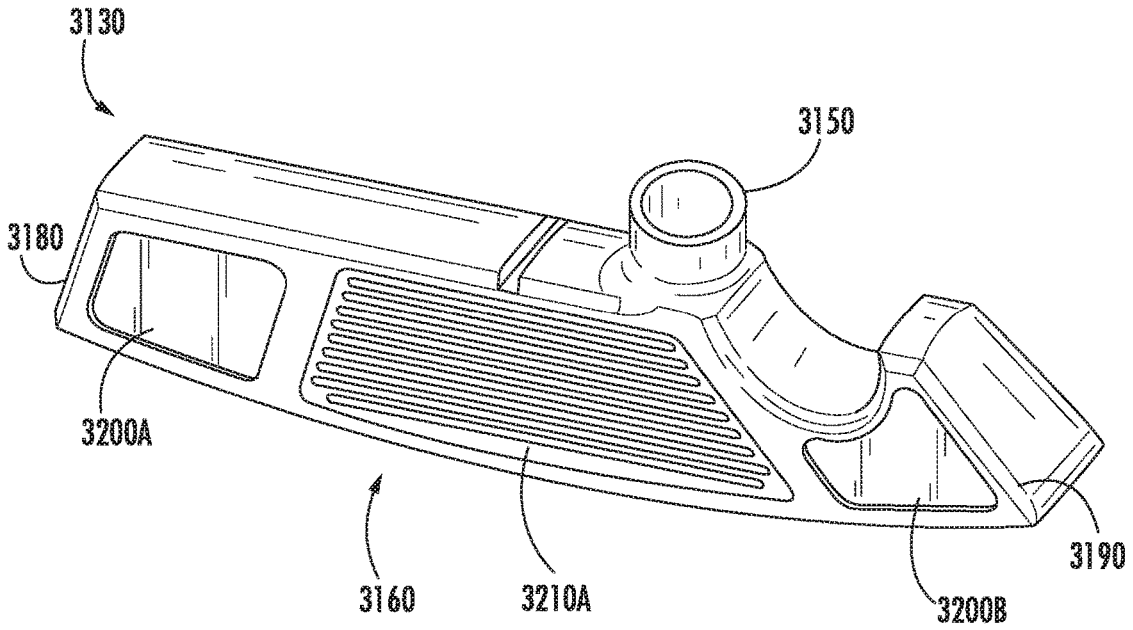
FIG. 6A is a top front perspective view of a clubhead in accordance with an embodiment of this invention; and, FIG. 6B is a top rear perspective view of a clubhead in accordance with an embodiment of this invention.
Figure 6B:
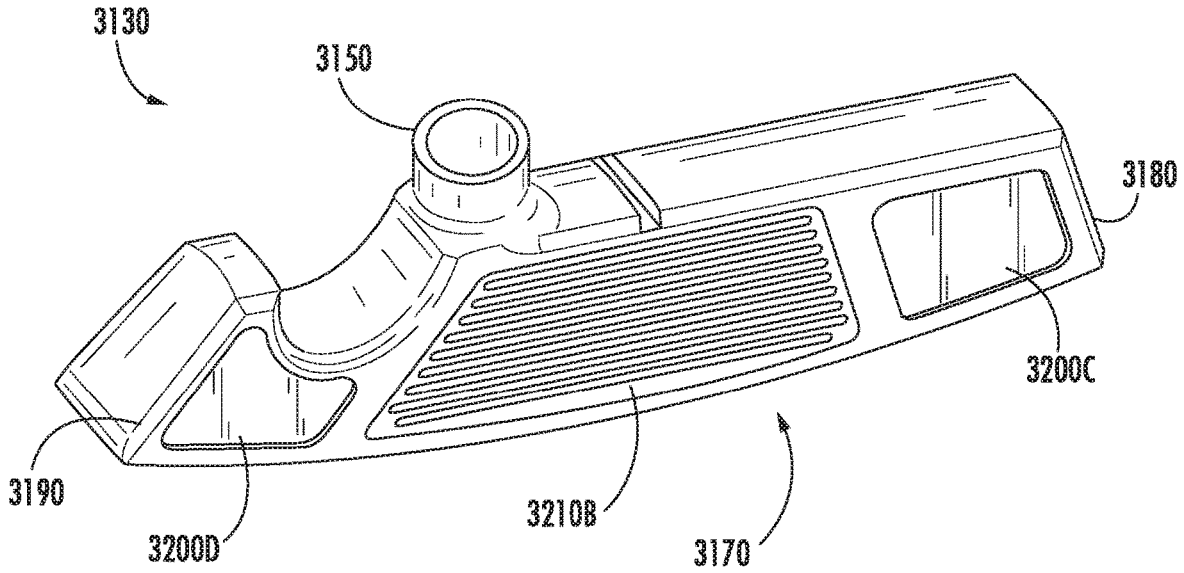

In further illustration of the invention, FIGS. 3 through 4C shows views of a golf club 2110 in accordance with another embodiment of this invention. As can be seen, golf club 2110 includes a shaft 2140 and a clubhead 2130 coupled to the shaft 2140 by a hosel 2150. The clubhead 2130 includes a face 2160, a toe 2180 at a distal end of the clubhead and a heal 2190 at an opposite distal end of the clubhead and opposite the toe. As well, the clubhead may include an insert 2210 and weighting materials 2200A and 2200B. The clubhead may have material removed to reduce the total weight of the clubhead as shown in FIG. 4C. Preferably, the material would be removed around the centerline of the clubhead to optimize the swingweight relative to the total weight of the clubhead and/or to reduce the total weight of the clubhead. As can be seen from FIG. 4C, the material removed is offset from the shape of the putter. However, material may be removed from any area of the clubhead and in any shape in order for the clubhead to address the desired weighting schemes of the user.

As discussed above, the putter clubhead 2130 may be made from stainless steel or carbon steel and the insert 2210 may be made from magnesium. The weighting materials 2200A and 2200B may be made from tungsten. Accordingly, for each cubic centimeter of magnesium used, 0.55 to 0.65 cubic centimeters of stainless steel or carbon steel of the clubhead is replaced with tungsten throughout weighting materials 2200A and 2200B. In order to maximize swingweight relative to total weight, the weighting materials 2200A and 2200B are placed as far forward to the front face 2160 away from the centerline of the clubhead. As well, the weighting materials 2200A and 2200B are placed closer to the toe 2180 and heel 2190, in order to maximize the toe/heel weighting characteristics of each of the weights. Furthermore, the components of embodiment shown in FIGS. 3 through 4C may be of the same material and manufacturing processes described above.

In further illustration of the invention, FIGS. 5A through 6B shows views of a golf club 3110 in accordance with yet another embodiment of this invention. As can be seen, golf club 3110 includes a shaft 3140 and a clubhead 3130 coupled to the shaft 3140 by a hosel 3150. The clubhead 3130 includes two faces 3160 and 3170 opposite one another, a toe 3180 at a distal end of the clubhead and a heal 3190 at an opposite distal end of the clubhead and opposite the toe 3180. As well, the clubhead may include inserts 3210A and 3210B and weighting materials 3200A, 3200B, 3200C and 3200D. The clubhead may have material removed to reduce the total weight of the clubhead. Preferably, the material would be removed around the centerline of the clubhead to optimize the swingweight relative to the total weight of the clubhead and/or to reduce the total weight of the clubhead. However, material may be removed from any area of the clubhead and in any shape in order for the clubhead to address the desired weighting schemes of the user.

As discussed above, the putter clubhead 3130 may be made from stainless steel or carbon steel and the inserts 3210A and 3210B may be made from magnesium. The weighting materials 3200A, 3200B, 3200C and 3200D may be made from tungsten. Accordingly, for each cubic centimeter of magnesium used, 0.55 to 0.65 cubic centimeters of stainless steel or carbon steel of the clubhead is replaced with tungsten throughout weighting materials 3200A, 3200B, 3200C and 3200D. In order to maximize swingweight relative to total weight, the weighting materials 3200A, 3200B, 3200C and 3200D are placed as far forward to the faces 3160 and 3170 away from the centerline of the clubhead. As well, the weighting materials 3200A, 3200B, 3200C and 3200D are placed closer to the toe 3180 and heel 3190, in order to maximize the toe/heel weighting characteristics of each of the weights. Furthermore, the components of embodiment shown in FIGS. 5A through 6B may be of the same material and manufacturing processes described above.

In the embodiment shown in FIGS. 5A through 6B, the desired weighting characteristics of the golf club may be adjusted based on the weighting materials, such as the swingweighting, foreweighting, backweighting, toe weighting and heel weighting. As such, it is desirable to have the weights as far forward as possible in order to optimize the swingweight relative to the total weight of the club. Furthermore, as shown in FIGS. 5A through 6B, the golf club can be used interchangeable from a left-handed user and a right-handed user.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise.

It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A golf club comprising:

a shaft;

a clubhead coupled to the shaft by a hosel;

the clubhead comprising a face, a toe at a distal end of the clubhead and a heel at an opposite distal end of the clubhead and opposite the toe;

a magnesium insert disposed on the face of the clubhead between the toe and heel of the clubhead as a striking surface of the clubhead;

a hollowed out portion of the clubhead at a bottom surface of the clubhead along a centerline of the clubhead wherein the hollowed out portion is near and offset on all sides from the outer perimeter of the clubhead; and, weighting material of a second density that is more than a first density of a material of the clubhead in place of a portion of the material of the clubhead and disposed separately at each of the toe and heel.

2. The golf club of claim 1, wherein the magnesium insert is formed entirely from magnesium.

3. The golf club of claim 1, wherein the magnesium insert is formed entirely from a magnesium alloy.

4. The golf club of claim 1, wherein the clubhead is stainless steel.

5. The golf club of claim 1, wherein the clubhead is carbon steel.

6. The golf club of claim 1, wherein the weighting material is tungsten.

7. The golf club of claim 6, wherein for each cubic centimeter of magnesium of the insert, between 0.55 to 0.66 cubic centimeters of the material of the clubhead is replaced with the weighting material.

8. The golf club of claim 1, wherein the weighting material comprises a first weighting material proximate to the toe of the clubhead and a second weighting material proximate to the heel of the clubhead.

9. A golf club comprising:

a shaft;

a clubhead coupled to the shaft by a hosel;

the clubhead comprising a face, a toe at a distal end of the clubhead and a heel at an opposite distal end of the clubhead and opposite the toe, wherein the clubhead is of a material selected from the group consisting of stainless steel and carbon steel;

a magnesium insert disposed on the face of the clubhead between the toe and heel of the clubhead as a striking surface of the clubhead, wherein the magnesium insert is formed entirely from a magnesium alloy;

weighting material disposed on the face of the clubhead separately at both the heel and toe, the weighting material comprising tungsten, wherein the weighting material comprises a first weighting material proximate to the toe of the clubhead and a second weighting material proximate to the heel of the clubhead;

a hollowed out portion of the clubhead at a bottom surface of the clubhead along a centerline of the clubhead wherein the hollowed out portion is near and offset on all sides from the outer perimeter of the clubhead; and, wherein for each cubic centimeter of magnesium of the insert, between 0.55 to 0.66 cubic centimeters of the material of the clubhead is replaced with the weighting material.

* * * * *